United States Patent [19]

Biller

[11] 4,355,727

[45] Oct. 26, 1982

[54] INTERMEDIATE SUPPORT FOR A SKYLINE LOGGING SYSTEM

[75] Inventor: Cleveland J. Biller, Morgantown, W. Va.

[73] Assignee: The United States of America as represented by the Secretary of Agriculture, Washington, D.C.

[21] Appl. No.: 115,538

[22] Filed: Jan. 25, 1980

[51] Int. Cl.[3] ..... B66C 21/00

[52] U.S. Cl. ..... 212/121; 104/115

[58] Field of Search ..... 212/71–72, 212/74–76, 78, 83, 87, 90–91, 94, 97, 113, 117, 121; 104/115–116, 124, 125, 178, 181–182, 197, 87, 93, 110, 111, 112, 180; 248/65; 254/388

[56] References Cited

U.S. PATENT DOCUMENTS

| | | | |
|---|---|---|---|
| 1,144,060 | 6/1915 | Phillips | 104/115 |
| 1,206,581 | 11/1916 | Opsal | 104/115 |
| 1,222,007 | 4/1917 | McGuire | 104/115 |
| 1,484,387 | 2/1924 | Dickinson | 104/115 |
| 1,569,176 | 1/1926 | Dunham | 212/90 |
| 1,793,395 | 2/1931 | Gum | 104/115 |
| 1,801,527 | 4/1931 | Newell | 104/115 |
| 2,378,081 | 6/1945 | Holman | 104/115 |
| 3,382,816 | 5/1968 | Goforth et al. | 104/197 |

FOREIGN PATENT DOCUMENTS

| | | | |
|---|---|---|---|
| 649467 | 2/1962 | Canada | 104/182 |

*Primary Examiner*—John J. Love
*Assistant Examiner*—L. E. Williams
*Attorney, Agent, or Firm*—M. Howard Silverstein; David G. McConnell

[57] ABSTRACT

An intermediate supporting device for a logging cable for supporting the cable above ground at an intermediate location. The device is arranged to permit a logging carriage to travel past the intermediate location substantially without being obstructed by the device. The device consists of a supporting sheave assembly supported on a transverse line extending between two intermediate spars or spar trees. A first horizontal shaft is swivelly connected to the lower end of the sheave assembly. A normally vertical link bar is pivotally connected at its top end to the first shaft and is pivotally connected at its bottom end to a second horizontal shaft which is parallel to the first shaft. Rigidly secured perpendicularly to the second shaft beneath the supporting sheave assembly is a support body member having spaced transverse vertical flanges with horizontally aligned peripherally grooved pulleys journalled therebetween, the flanges having holes to receive a haulback line engaged in the grooves of the pulleys. Rigidly mounted on the flanges above the pulleys is a rail member with inclined ends to serve as a guide support for the upper grooved pulleys of an open-sided logging carriage, permitting the carriage to travel smoothly past the intermediate supporting device.

15 Claims, 14 Drawing Figures

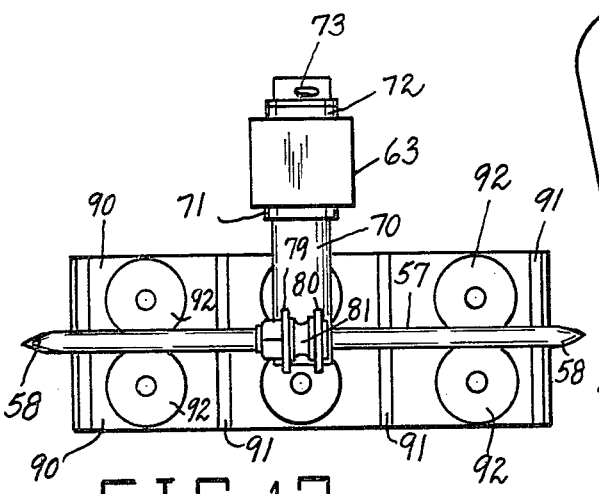
FIG. 12
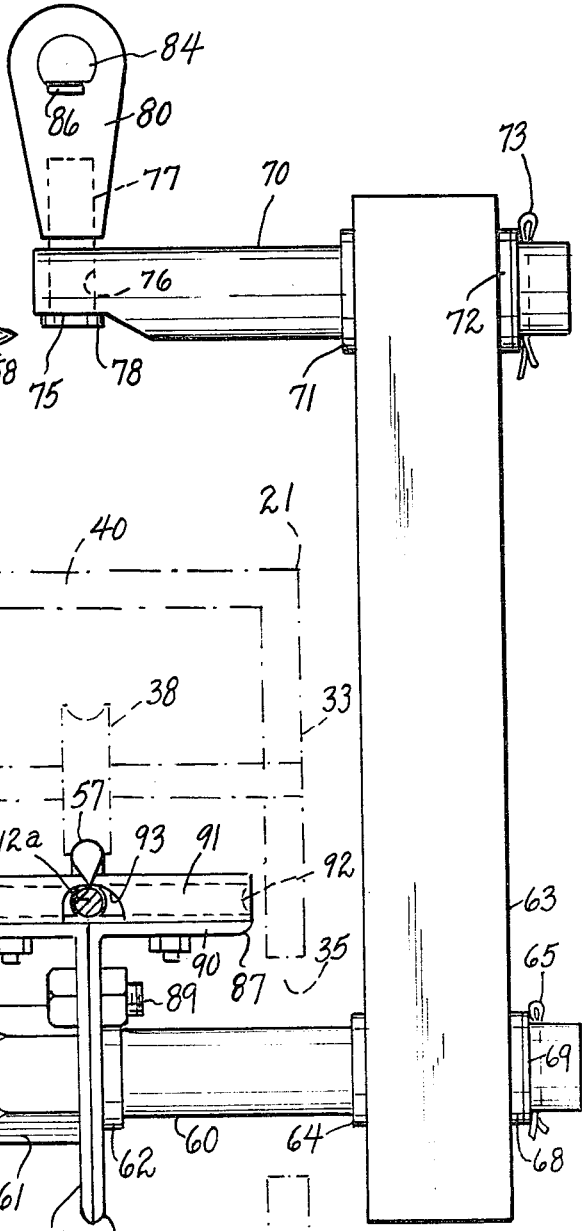
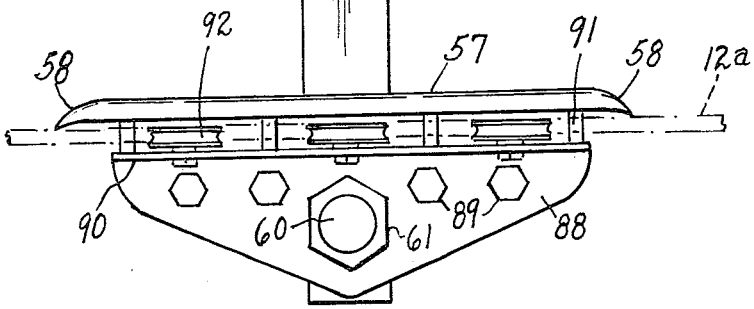
FIG. 13
FIG. 14

INTERMEDIATE SUPPORT FOR A SKYLINE LOGGING SYSTEM

This application is related to, in the sense that it has some common subject matter, to the three co-pending patent applications as follows:

Ser. No. 102,484 by Joseph W. Gorsh titled "Running Skyline Intermediate Support and Multi-span Carriage"

Ser. No. 210,460 by Cleveland J. Biller and David D. Johnson titled "Carriage for Cable Logging System"

Ser. No. 242,513 by Cleveland J. Biller and David D. Johnson titled "Roller Intermediate Sypport for Cable Logging System."

FIELD OF THE INVENTION

This invention relates to skyline logging systems, and more particularly to improvements in intermediate support devices for supporting logging cables above ground at an intermediate location of the cable system and for allowing the associated logging carriage to move smoothly past the intermediate support device employed therewith.

BACKGROUND OF THE INVENTION

Skyline logging systems are cable logging systems used to harvest timber from relatively irregular terrain, such as hillsides too steep for normal tractor logging. Skyline systems utilize a movable carriage similar to a trolley, supported on a cable, to move logs from the location where they are felled to a landing, namely, a location where the logs are concentrated for loading onto trucks or similar vehicles. During the in-haul phase of the operation, the logs are carried suspended from the ground. An intermediate support for the skyline is employed where the haulback cable is relatively long or where there is a rise or hump between the running skyline yarder and the location from which the logs are transported, to provide the necessary ground clearance.

Logging over a cable provided with an intermediate support has been performed for many years. Since its inception it has been used both with standing skyline systems, namely, systems wherein the load-carrying skyline is anchored at one end and the other end is held in position by means of a brake, and with systems wherein the intermediate support engages a running line rather than a stationary line, namely, a system wherein the haulback line moves in a direction opposite to that of the moving carriage employed in the system. This requires that the carriage must be able to smoothly pass the required intermediate support device while the support device continues to adequately support and retain the associated fast-moving and undulating cable.

Previously employed intermediate support devices in live skyline systems or running skyline systems for logging or for use in other operations, such as in construction work for moving equipment or material to a construction site have been relatively unsatisfactory. In some of the prior systems the ropes or cables are quickly damaged or ruptured, in others the associates sheaves or pulleys are subjected to excessive wear so as to cause disengagement of the cable therefrom when the cable is slackened, and in still others there is excessive cable friction, causing heating and damage to the cable, as well as creating substantial fire hazards to the adjacent environment. There is a substantial need for an improved intermediate support device which avoids these disadvantages.

In general, a skyline system consists of a cable supported above ground, with a carriage which rides back and forth, and which should be able to travel over the intermediate support device without stopping and without requiring any additional action on the part of the operator. A "running" skyline system is a system of two or more suspended moving lines, generally referred to as "main" and "haulback," which when properly tensioned will provide lift and travel to the associated load carrier. A "live" skyline system employs a carriage, a main line and a haulback line, wherein the main and haulback lines are attached directly to the carriage.

Systems of this type are used not only in the timber harvesting industry, but also in the construction industry where a cable system is employed to move equipment or material to a building site, for example, to move concrete to a pouring area on a dam, and wherein the intermediate support facilitates the provision of extra lift as required, and wherein such support is needed to clear obstacles.

When a live skyline or running skyline is used and the tension is released (such as in a live skyline during the unloading phase of the yarding cycle, or in a running skyline system during the loading and unloading phase of the yarding cycle), there is a need for means to hold the skyline in place on the intermediate support. When the skyline is slackened, the cable must be allowed to slide through the intermediate support, usually toward the downhill side of the support. When the skyline is tightened, slack must be pulled back through the intermediate support.

A preliminary search of the prior art revealed the following prior U.S. patents of interest:

Horner, U.S. Pat. No. 688,522
Vogel et al., U.S. Pat. No. 1,076,337
Wagner, U.S. Pat. No. 1,090,253
Martin, U.S. Pat. No. 1,112,017
Opsal, U.S. Pat. No. 1,206,581
McGuire, U.S. Pat. No. 1,222,007
Also of interest is French Pat. No. 1,441,421.

SUMMARY OF THE INVENTION

Accordingly, a main object of the invention is to provide a novel and improved intermediate support device for a skyline cable system which overcomes the deficiencies and disadvantages of the previously employed intermediate support devices.

A further object of the invention is to provide an improved skyline cable system intermediate support device which is simple in construction, which involves relatively few parts, and which employs aligned guide openings and pulley members to hold the cable in place thereon, thereby allowing the cable to move smoothly across the intermediate support and enabling the associated cable system to operate with high efficiency.

A still further object of the invention is to provide an improved intermediate support device for a cable system which effectively retains the cable during loading and unloading phases of the operating cycle of the cable system, which permits the associated load carriage to move smoothly thereover with a minimum amount of noise and friction, even at relatively rapid speeds, and which minimizes frictional heating and wear of the associated load-supporting cable.

A still further object of the invention is to provide an improved skyline logging intermediate support device which may be employed on a live skyline or a running skyline system to support the skyline at a substantial height off the ground at a required intermediate location to provide ground clearance for a load transported by the skyline, the intermediate support device having simple and efficient cable retaining means to prevent disengagement of the associated cable therefrom, having rail means over the cable retaining means arranged to elevate the associated load-bearing carriage and cause it to pass smoothly over the intermediate support device as the cable passes through the device, and permitting relatively rapid longitudinal movement of the associated cable relative to the intermediate support device without causing excessive heating or abrasion of the cable.

BRIEF DESCRIPTION OF THE DRAWINGS

Further objects and advantages of the invention will become apparent from the following description and claims, and from the accompanying drawings, wherein:

FIG. 12 is a top plan view of a modified form of intermediate support device according to the present invention.

FIG. 13 is a side elevational view of the modified intermediate support device of FIG. 12.

FIG. 14 is an enlarged end elevational view of the intermediate support device of FIGS. 12 and 13.

DESCRIPTION OF PREFERRED EMBODIMENTS

Figure 1:
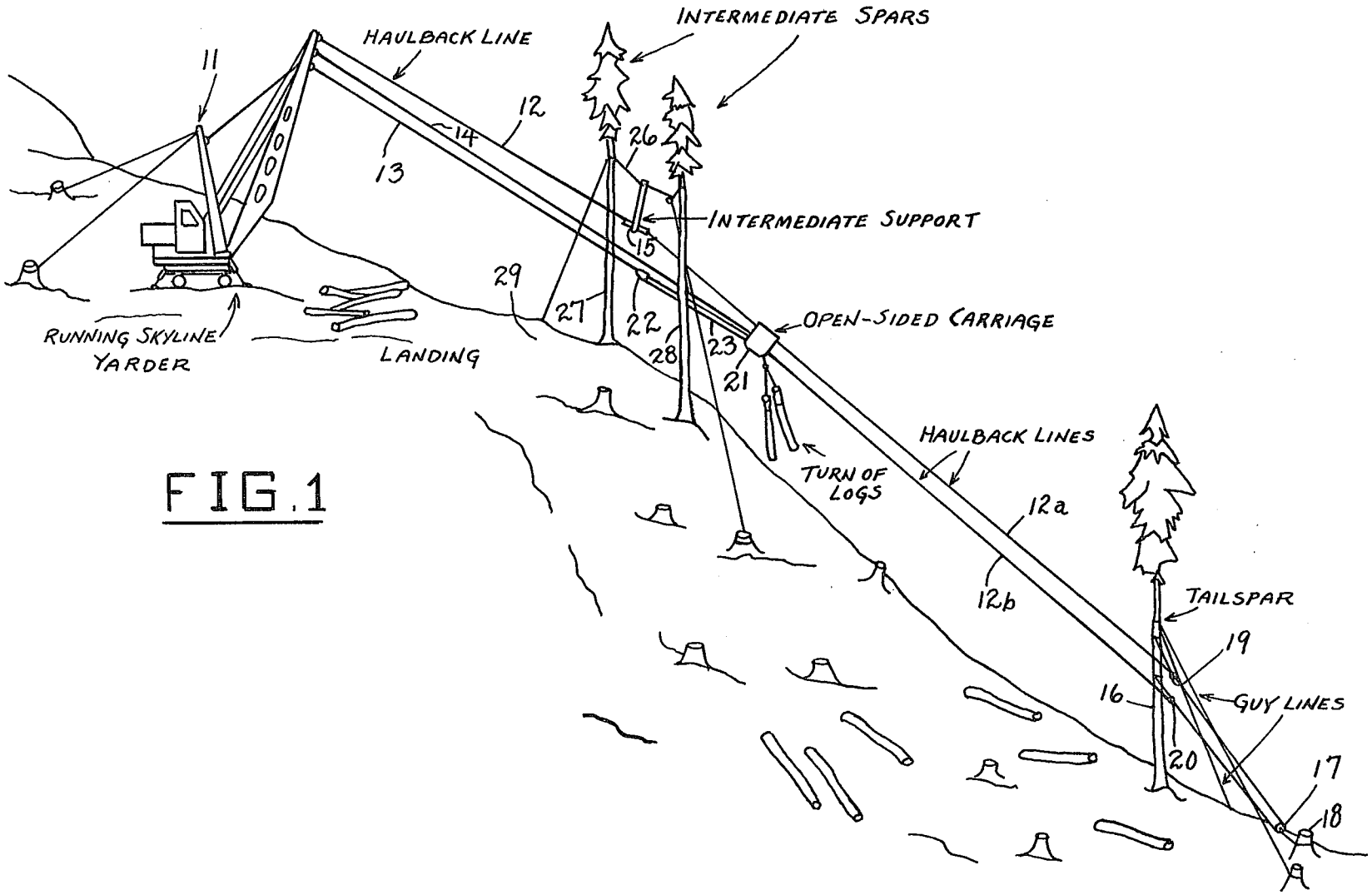
FIG. 1 is a schematic illustration of a typical multi-span skyline logging system employing an improved intermediate support device according to the present invention.
Figure 2:
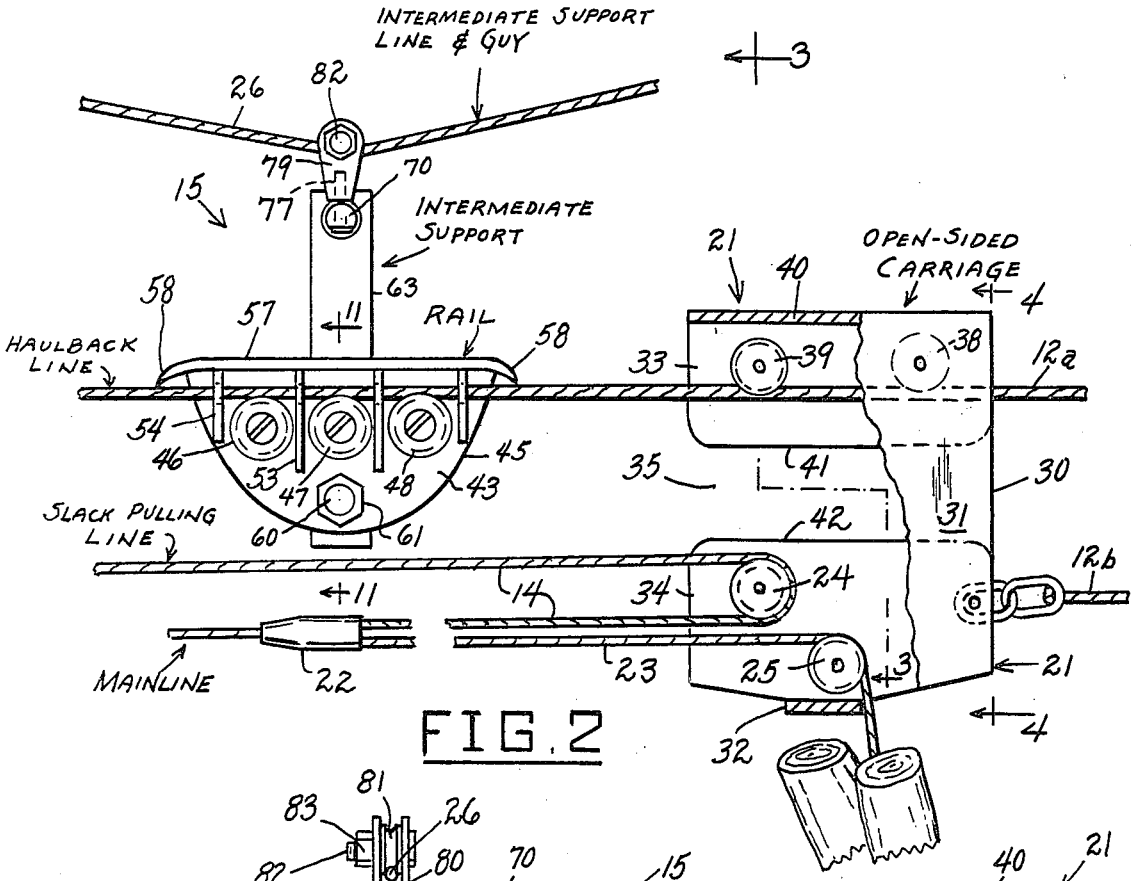
FIG. 2 is a fragmentary side elevational view of an intermediate support device according to the present invention and of an associated open-sided load-bearing carriage which may be employed in the logging system of FIG. 1.

Referring to the drawings, FIG. 1 diagrammatically illustrates a typical multi-span, running skyline logging system which employs a conventional yarder 11 with rigging including a haulback line 12, a mainline 13 and a slack pulling line 14. The haulback line 12 extends over an intermediate support assembly 15 located at a suitable position between the yarder 11 and a tailspar tree 16 near the log-felling location. In the illustrated typical system, the haulback line extends around a sheave 17 anchored to a stump 18, the upper and lower haulback line elements 12*a* and 12*b* being supported on respective sheaves 19 and 20 connected to the tailspar tree 16. The lower haulback line element 12*b* is connected to a conventional open-sided carriage 21 movably supported on the upper haulback line element 12*a*, as will be presently described. The mainline 13 is connected to a junction member 22, to which are respectively connected the slack pulling line 14 and the load supporting line 23. As shown in FIG. 2, the slack pulling line 14 and the load supporting line 23 extend around respective spaced peripherally grooved sheaves 24 and 25 journalled in the lower portion of carriage 21.

The intermediate support assembly 15 may be suspended from a support line and guy cable 26 connected to and supported on a pair of intermediate spar trees 27 and 28 suitably located on opposite sides of the haulback and other rigging lines at the region requiring the extra height of the lines, for example, at a hump or rise 29 between the yarder 11 and the tailspar tree 16.

Figure 3:
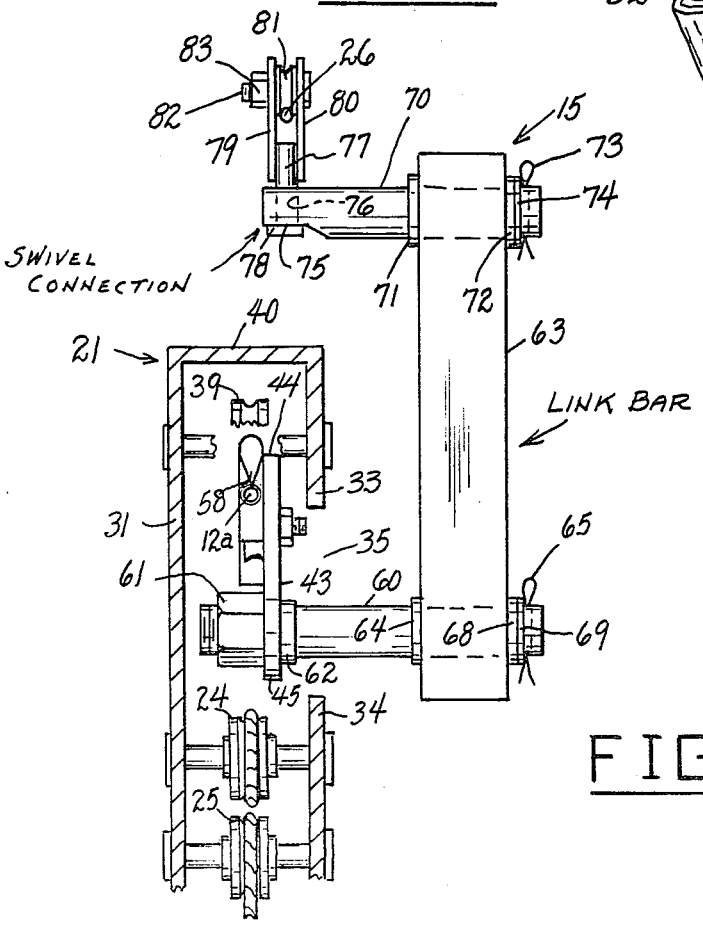
FIG. 3 is an enlarged fragmentary transverse vertical cross-sectional view taken substantially on line 3—3 of FIG. 2.
Figure 4:
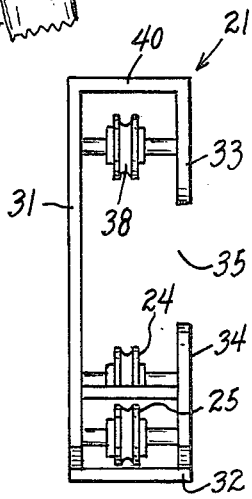
FIG. 4 is an end elevational view of the carriage, taken substantially on line 4—4 of FIG. 2.

Referring to FIGS. 2, 3 and 4, the carriage 21 may comprise a generally rectangular sleeve-like main body 30 having a main sidewall 31, a full-length top wall 40, a reduced-length bottom wall 32 subjacent the load-bearing sheave 25, of sufficiently short length to provide clearance for the depending portion of load-supporting line 23, and upper and lower rear wall flanges 33, 34 defining a longitudinal open slot 35 therebetween.

A top peripherally grooved sheave 38 is journalled in the upper right portion of the carriage body 30, as viewed in FIG. 2. Another peripherally grooved top sheave 39 is journalled in the upper left portion of said carriage body, as shown in FIG. 2. The bottom edge 41 of flange 33 is located a substantial distance below the level of the bottoms of the peripheries of the sheaves 39, 38. The top edge 42 of lower flange 34 is located above the level of the top of the periphery of sheave 24.

Figure 8:
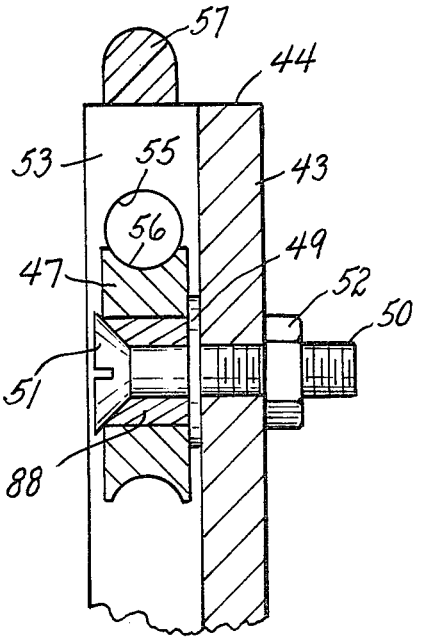
FIG. 8 is an enlarged fragmentary transverse vertical cross-sectional view taken substantially on line 8—8 of FIG. 5.

The intermediate support assembly 15 comprises a plate-like main body portion 43 having a straight top edge 44 and a generally parabolic remaining peripheral edge 45. In the typical embodiment illustrated in the drawings, three peripherally grooved, evenly spaced pulleys 46, 47 and 48 are journalled to the plate-like main body 43 with their axes in a plane spaced below and parallel to top edge 44. As shown in FIG. 8, the pulleys may be rotatably mounted on respective annular bushings 88 clamped against enlarged washers 49 by flared-head bolts 50, the bolt heads 51 being sufficiently large to retain the pulleys on the bushings 48. The bolts 50 are clamped against the bushings by respective nuts 52 provided on the bolts.

Figure 5:
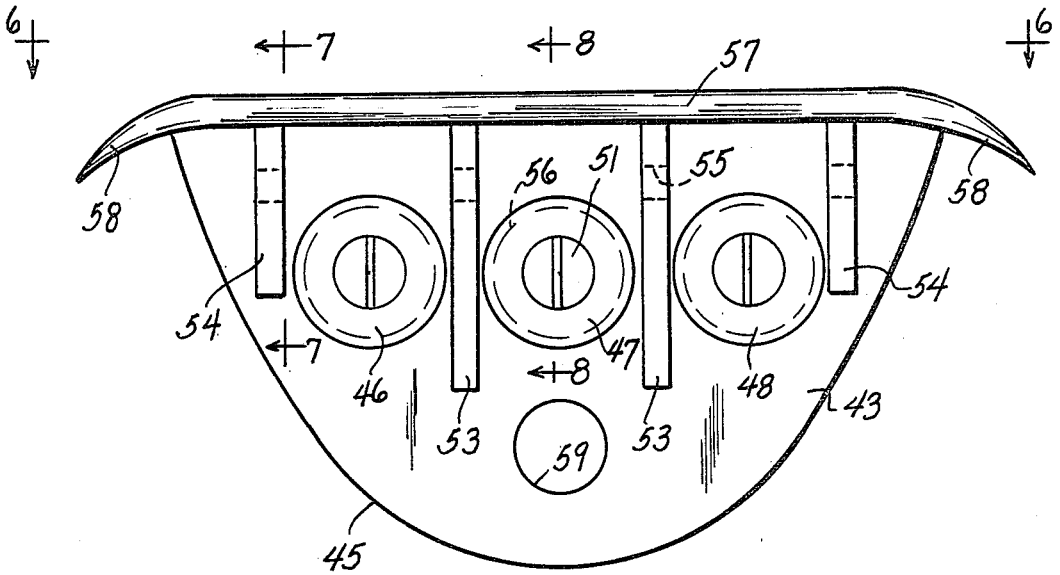
FIG. 5 is an enlarged side elevational view of the main body portion of the intermediate support device shown in FIG. 2.
Figure 6:
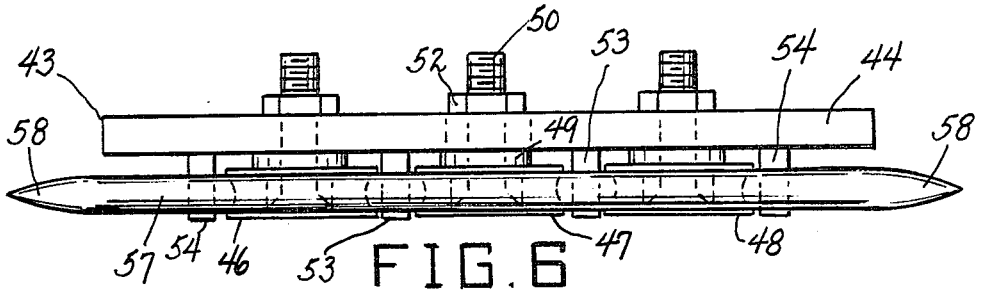
FIG. 6 is a top plan view taken substantially on the line 6—6 of FIG. 5.
Figure 7:
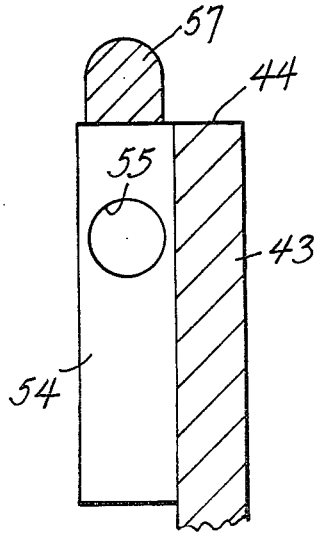
FIG. 7 is an enlarged fragmentary transverse vertical cross-sectional view taken substantially on line 7—7 of FIG. 5.

Relatively long plate-like parallel rectangular flanges 53, 53 are rigidly secured perpendicularly on the main body portion 43 on opposite sides of the central pulley 47, extending normally to the plane of edge 44 and having their top edges flush therewith, as shown in FIG. 8. Similar shorter rectangular flanges 54, 54 are respectively provided on the body portion 43 outwardly adjacent to the outer pulleys 46, 48. Thus, as shown in FIGS. 5, 6 and 8, the spaced parallel flanges 54, 53, 53, 54 extend beyond the outer planes of the pulleys 46, 47 and 48 and define enclosures for said pulleys. The upper portions of said flanges are formed with aligned cable-receiving apertures 55 which are substantially aligned with the top portions of the peripheral grooves 56 of the pulleys, as shown in FIG. 8. Said apertures are arranged to loosely receive the haulback line 12*a* and to retain said line substantially in the grooves 56 of the pulleys as the line moves relative to the intermediate support 15.

Rigidly secured on the top edges of the flanges 54, 53, 53, 54 in vertical alignment with the apertures 55 is an elongated rail bar 57 having an arcuately rounded top cross-sectional contour conformably receivable in the peripheral grooves of the carriage pulleys 39, 38, and having opposite downwardly arcuately inclined, tapered, end ramps 58, 58 to facilitate the smooth elevation and descent of said carriage pulleys 39, 38 as the carriage moves past the intermediate support 15.

Figure 11:
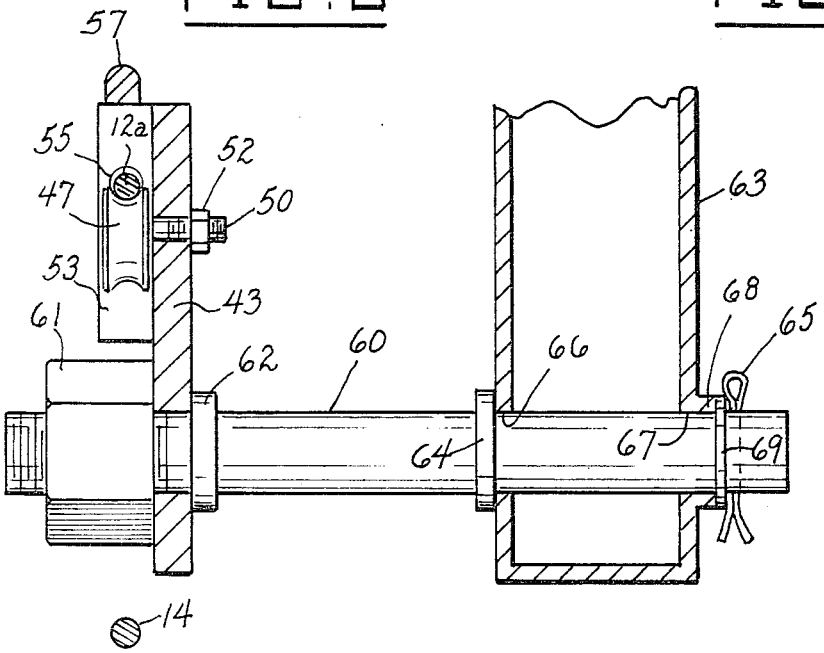
FIG. 11 is an enlarged fragmentary transverse vertical cross-sectional view taken substantially on line 11—11 of FIG. 2.

Vertically aligned with and spaced below the middle pulley 47 is an aperture 59 formed in the main body portion and receiving an elongated bottom link pivot shaft 60, as shown in FIG. 3. Pivot shaft 60 is rigidly clamped perpendicularly to body portion 43 by a clamping nut 61 cooperating with an integral abutment collar 62 on the pivot shaft 60. The outer end of pivot shaft 60 is rotatably received through the bottom end portion of a hollow rectangular link bar 63 retained substantially in bearing contact with another integral abutment collar 64 provided on link shaft 60 by a cotter pin 65. As shown in FIG. 11, the lower portion of the hollow link bar 63 may be formed with a first shaft-receiving aperture 66 and an opposite aperture 67 with an integral outer bearing flange 68. The outer end of the link shaft 60 is secured in the aligned apertures 66, 67 by the cotter pin 65, with a bearing washer 69 interposed between cotter pin 65 and bearing flange 68. Thus, the shaft 60 is secured perpendicularly to the link bar 63, but relative rotation between the link bar 63 and the main body 43 around the axis of shaft 60 is freely permitted.

As shown in FIG. 3, the top end portion of link bar 63 is similarly pivotally connected to a top link shaft 70, said link shaft 70 having an integral abutment collar 71 on one side, and the link bar 63 having a shaft aperture with an integral bearing flange 72 on the opposite side, the shaft 70 being secured rotatably to the link bar by a cotter pin 73 bearing against a washer 74, as in the case of the bottom link bar pivotal connection.

Figure 9:
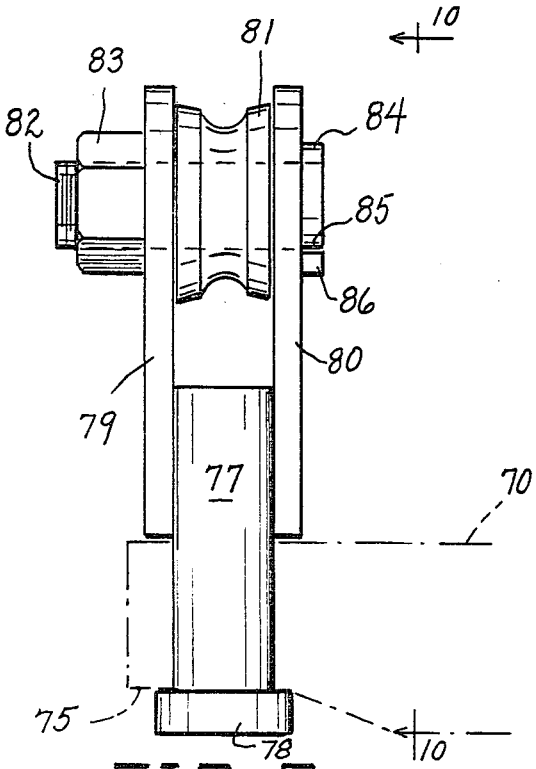
FIG. 9 is an enlarged side elevational veiw of the support hanger employed in the intermediate support device of FIG. 2.
Figure 10:
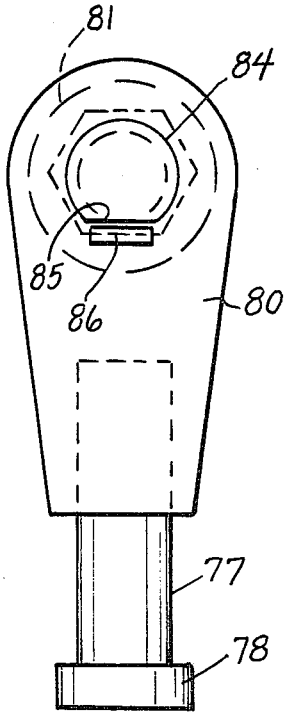
FIG. 10 is an elevational view of the support hanger taken substantially on line 10—10 of FIG. 9.

As shown in FIG. 3, the top link shaft 70 is parallel to the bottom link shaft 60 and extends over the plate-like main body 43, being perpendicular to the plane of said main body. The end portion of said top link shaft above the main body is flattened at its bottom, as shown at 75. Said link shaft end portion is formed with a swivel aperture 76 in which is disposed a swivel bolt 77 having an enlarged head portion 78 received in the recess defined by the flat portion 75. The shank of the swivel bolt 77 is welded between a pair of parallel plate-like hanger bar members 79, 80, as shown in FIGS. 9 and 10, whose bottom ends terminate closely adjacent to the link shaft 70, so as to cooperate with the bolt head 78 to maintain a close-fitting swivel relationship between top link shaft 70 and swivel bolt 77.

A supporting sheave pulley 81 is journalled between the upper portions of hanger bar members 79, 80 by means of a headed bearing bolt 82 engaged through said hanger bar members and provided with a retaining nut 83. The head 84 of the bolt 82 may be flattened at 85, and a stop lug 86 welded to bar member 80 may be employed to cooperate with the flattened head portion 85 to hold the bolt 82 against rotation, as shown in FIGS. 9 and 10.

The support hanger assembly is engaged on the intermediate support line 26 in the manner illustrated in FIG. 2. In operation, as the carriage 21 reaches the intermediate support 15, for example, moving leftwardly in FIG. 2, the pulleys 39, 38 are elevated onto the rail member 57 by the rightward ramp member 58. The lower link shaft 60 is received in the carriage slot 35, allowing the carriage 21 to move past the intermediate support. The haulback line 12*a* is meanwhile moved through the apertures 55, riding on the grooved pulleys 46, 47, 48. As the carriage passes the intermediate support, the pulleys 39, 38 descend from the rail member 57 via the leftward ramp element 58 and resume their supportive engagement with the haulback line 12*a*. Thus, the movement of the carriage 21 past the intermediate support 15 takes place smoothly, with relatively light impact and with only a small amount of friction.

In some carriages it may be desirable to employ smaller additional sheave pulleys ahead of the main pulleys 39, 38 to facilitate the lifting of the main pulleys onto the rail member 57 as the carriage starts to ride onto said rail member.

As above mentioned, the rail member 57 has a rounded top contour conformably engageable in the peripheral grooves of the carriage pulleys 39, 38, namely, similar in size and contour to the pulley-engaging portions of cable 12*a*.

In the modification shown in FIGS. 12, 13 and 14, the intermediate support device comprises a pair of angle bars 87, 87 with depending vertical flanges 88, 88 rigidly secured together by a plurality of spaced clamping bolts 89, with their horizontal flanges 90, 90 extending outwardly in opposite directions and in a coplanar relationship. The clamped depending flanges 88, 88 are substantially in vertical alignment with suspension bolt 77, are centrally apertured to receive the lower pivot shaft 60, and are rigidly secured thereto by the clamping nut 61.

A plurality of upstanding cross flanges 91 are transversely, perpendicularly and rigidly secured on the coplanar horizontal flanges 90, 90 in spaced relationship, and journalled to said horizontal flanges 90 between the cross flanges 91 are respective symmetrically arranged cooperating pairs of horizontal peripherally-grooved pulleys 92, 92, located to define aligned guide passageways therebetween for the haulback cable element 12*a*. The cross flanges 91 are formed with central apertures 93 aligned with the guide passageways between the pairs of pulleys 92, 92, to slidably receive the cable element 12*a* therethrough, as shown in FIG. 14.

The rounded-top, oppositely tapered carriage guide rail member 57 is rigidly secured, as by welding, centrally on the spaced transverse cross flanges 91 in a position above and vertically aligned with the cable guide apertures 93, as shown in FIG. 14.

In operation, the haulback cable element 12*a* passes between the spaced cooperating pairs of horizontal guide pulleys 92, 92 and through the intervening guide apertures 93. As the carriage 21 reaches the intermediate support, the pulleys 39, 38 thereof are elevated onto the rail member 57 by the foremost ramp member 58, the lower link shaft 60 being received in the carriage slot 35, as previously described, allowing the carriage 21 to move smoothly past the intermediate support. As the carriage passes the intermediate support, the pulleys 39, 38 descend from the rail member 57 via the leftward ramp element 58, assuming the carriage to be travelling from right to left in FIG. 13, and resume their supportive engagement with the haulback line 12*a*.

While certain specific embodiments of improved supporting devices for skyline cable systems have been disclosed in the foregoing description, it will be understood that various modifications within the scope of the invention may occur to those skilled in the art. Therefore it is intended that adaptations and modifications should and are intended to be comprehended within the meaning and range of the disclosed embodiments.

What is claimed is:

1. In a skyline cable system of the type including a load-supporting cable and a load carrying carriage having an open side and having supporting pulley means engaged on said cable, an intermediate supporting assembly comprising intermediate spar means provided with attachment means overlying an intermediate portion of said cable, suspension means supportingly engaged with said attachment means, support body means located below and substantially in vertical alignment with said suspension means, guide means on the support body means slidably and retentively receiving the load-supporting cable, elongated rail means rigidly connected to said support body means and spaced above and extending substantially parallel to said cable and being formed to engage with and elevate the carriage off of said cable as the carriage moves past said intermediate supporting assembly on said rail means, and said rail means being formed with a top surface simulating said cable, whereby the rail means serves the function of said cable and directly supports said carriage when said carriage passes said intermediate supporting assembly, and whereby said guide means causes said cable to pass smoothly over said intermediate supporting assembly.

2. The skyline cable system of claim 1, supporting linkage means connecting said support body means to said suspension means, the supporting linkage means being formed to pass through said open side of the carriage, and wherein said supporting linkage means comprises first horizontal shaft means connected to said suspension means, depending link bar means pivoted to said first shaft means, second shaft means spaced below and being parallel to said first shaft means and being pivoted to said link bar means, and means rigidly connecting said second shaft means to said support body means.

3. The skyline cable system of claim 2, and means swivelly connecting said first shaft means to said suspension means.

4. The skyline cable system of claim 2, and wherein said attachment means comprises a support line connected to said spar means.

5. The skyline cable system of claim 4, and wherein said suspension means comprises a sheave pulley assembly engaged on said support line.

6. The skyline cable system of claim 5, and wherein said sheave pulley assembly is provided with a depending swivel bolt element and wherein said first horizontal shaft means is swivelly connected with said swivel bolt element.

7. The skyline cable system of claim 1, and wherein said guide means comprises a plurality of spaced parallel flange members projecting perpendicularly from said support body means and being formed with aligned guide apertures slidably receiving said load-supporting cable.

8. The skyline cable system of claim 7, and wherein said guide means includes at least one guide pulley journalled in said support body means between a pair of said flange members with its peripheral portion substantially aligned with the guide apertures of the flange members.

9. The skyline cable system of claim 8, and wherein said elongated rail means is rigidly mounted perpendicularly on said flange members.

10. The skyline cable system of claim 1, and wherein said elongated rail means is provided with arcuately downwardly inclined opposite end portions formed to define end ramps engageable at times by the supporting pulley means of the load carriage.

11. The skyline cable system of claim 1, and wherein said supporting linkage means comprises first horizontal shaft means, means swivelly connecting one end of said first shaft means to said suspension means for rotation around a substantially vertical axis, depending elongated link bar means pivoted at its top end to said first shaft means, second horizontal shaft means below and parallel to said first shaft means and pivoted to the lower end portion of said depending link bar means, and means rigidly connecting said second shaft means perpendicularly to said support body means.

12. The skyline cable system of claim 11, and wherein said guide means comprises a plurality of spaced parallel flange members perpendicularly secured to said support body means and being formed with aligned guide apertures slidably receiving said load-supporting cable.

13. The skyline cable system of claim 12, and respective peripherally grooved pulleys journalled to the support body means between the adjacent flange members with their peripheral grooves substantially aligned with the guide apertures and receiving said load-supporting cable.

14. The skyline cable system of claim 13, and wherein said elongated rail means is rigidly perpendicularly secured on said flange members.

15. The skyline cable system of claim 14, and wherein said elongated rail means is formed at its opposite ends with tapered downwardly arcuately formed ramp elements engageable at times with the supporting pulley means of the load carriage.

* * * * *